United States Patent [19]

Datta

[11] Patent Number: 4,904,377

[45] Date of Patent: Feb. 27, 1990

[54] SIFTING APPARATUS

[75] Inventor: Goutam Datta, Woodbridge, N.J.

[73] Assignee: Kason Corporation, Linden, N.J.

[21] Appl. No.: 224,100

[22] Filed: Jul. 26, 1988

[51] Int. Cl.[4] ..... B07B 1/55; B07B 1/18

[52] U.S. Cl. ..... 209/380; 209/295; 209/300; 239/550

[58] Field of Search ..... 209/300, 295, 380, 250; 239/112, 113, 550–600, 708, 264, DIG. 13

[56] References Cited

U.S. PATENT DOCUMENTS

| | | | |
|---|---|---|---|
| 987,657 | 3/1911 | Wagner | 209/300 X |
| 2,136,099 | 11/1939 | Buxbaum | 209/295 |
| 2,143,497 | 1/1939 | Rahmberg | 209/295 X |
| 2,389,715 | 11/1945 | Beardsley | 209/295 X |
| 2,751,079 | 6/1956 | Ahlmann | 209/380 X |
| 2,796,809 | 6/1957 | Sprau | 209/380 X |
| 3,081,873 | 3/1963 | Cowan et al. | 209/380 X |
| 3,143,493 | 8/1964 | Anderson | 209/380 X |
| 3,855,118 | 12/1974 | Mikolajczyk | 209/380 X |
| 3,963,608 | 6/1976 | Zimmermann et al. | 209/300 |
| 4,282,090 | 8/1981 | Hoernschemeyer et al. | 209/380 X |
| 4,685,569 | 8/1987 | Osaki et al. | 209/571 |

FOREIGN PATENT DOCUMENTS

| | | | |
|---|---|---|---|
| 245369 | 12/1910 | Fed. Rep. of Germany | 209/295 |
| 40476 | 5/1914 | Sweden | 209/295 |
| 4271 | 12/1975 | United Kingdom | 209/295 |

*Primary Examiner*—Donald T. Hajec

*Attorney, Agent, or Firm*—Wolder, Gross & Bondell

[57] ABSTRACT

An improvement for centrifugal sifter units having an elongated sifting chamber having a central axis, a coaxial screen surface therein and a series of paddles mounted on a shaft driven for rotation about the central axis for urging siftable material through the screen surface to separate fines from overs, comprises a series of nozzles mounted on the shaft for rotation therewith. The nozzles are oriented to direct gas streams at the screen surface whereby agglutinating fines are dislodged from each other and are directed through the screen surface. A source of compressed gas is operatively connected to the nozzles. The gas streams may be ionized to further improve throughput.

3 Claims, 2 Drawing Sheets

SIFTING APPARATUS

BACKGROUND OF THE INVENTION

The present invention relates generally to the field of centrifugal sorting devices and, in particular, to an improved centrifugal sorting apparatus especially adapted for use in conjunction with the sifting of materials which have a tendency to agglutinate, clump, or otherwise clog the sifting apparatus.

Centrifugal-type sorting or sifting units find great utility in numerous fields, including the chemical, food, dairy product, pharmaceutical and plastic industries. Such devices are often used to sort or sift both dry powder and granular materials, both to achieve a uniformity of sifted particle size ("fines") and to eliminate unwanted materials of a larger size ("overs") from the desired product. As the materials sought to be sifted are normally of a relatively small diameter, the screening material used to separate such material from the undesirable elements is relatively fragile and is subject to clogging.

In particular, numerous materials, such as epoxy paint pigments, demonstrate a tendency to agglutinate or collect together by virtue of static charges on the particles. The resulting clumps of material affix themselves to the sifting screen or mesh, and significantly lessen the efficiency and throughput of the sifting process. Other products, by virtue of their particle shape or other characteristics, similarly can clog the screen. The use of vanes, paddles and the like to assist in agitation of the mass to be sifted is often of little value, and sometimes serves to aggrevate the problem, as the increased agitation applied to the particles can increase the level of static charge thereon.

SUMMARY OF THE INVENTION

It is accordingly a purpose of the present invention to provide an improved centrifugal sorting apparatus which provides for greater efficiency, especially when used in conjunction with agglutinating materials.

A further purpose of the present invention is to provide a sifting apparatus of increased throughput which may be utilized in conjunction with a variety of materials to be sifted.

In accordance with the above and other objects, the present invention is adopted to be utilized in conjunction with a centrifugal sorting apparatus having a generally cylindrical sorting chamber, the circumference of which is provided with the screening material of proper mesh. Mounted coaxially within the sorting chamber is a shaft to which stirring paddles are affixed. The invention contemplates the positioning along the shift of nozzle means for directing a gaseous spray radially outward against the inner surface of the screening material. As the shaft and paddle assembly is rotated, these sprays sweep about the periphery of the screen. The nozzles are appropriately connected to a source of compressed gas, such as air, to allow the duration and extent of discharge to be controlled. In a preferred embodiment of the invention the shaft serves as the conduit for the gas, and is provided with appropriate outlets along its length. It has been found that, by use of such a spray apparatus, the throughput of materials prone to clumping may be substantially increased.

DESCRIPTION OF THE DRAWINGS

The above brief description, as well as other features and advantages of the present invention, will be more fully appreciated with reference to the following detailed description of a preferred, but nonetheless illustrative embodiment of the present invention when taken in conjunction with the following drawings, wherein.

DESCRIPTION OF A PREFERRED EMBODIMENT

Figure 1:
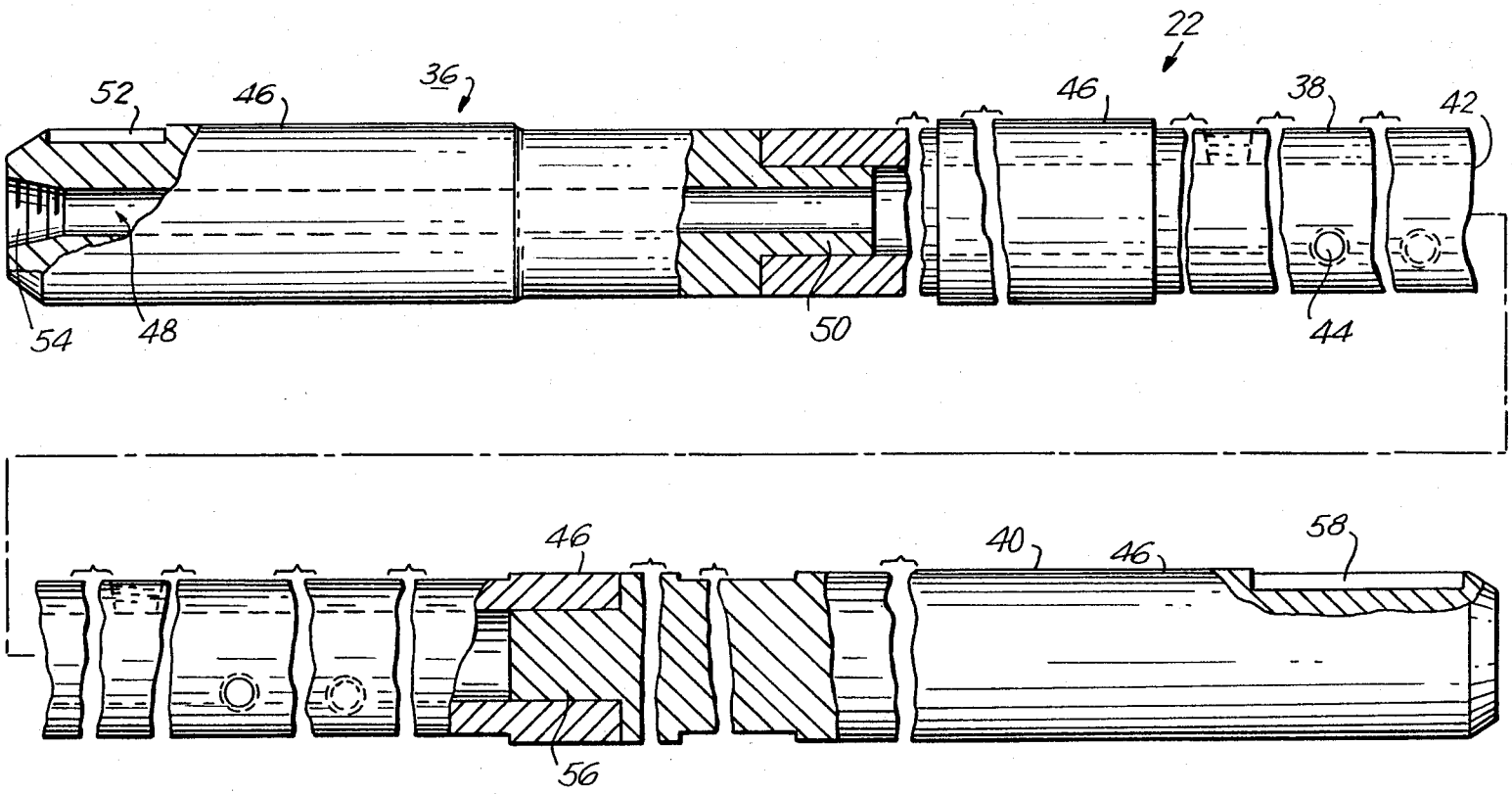
FIG. 1 is an elevation view, partially in section, of a typical shaft of the present invention to which the nozzle units are mounted.
Figure 2:
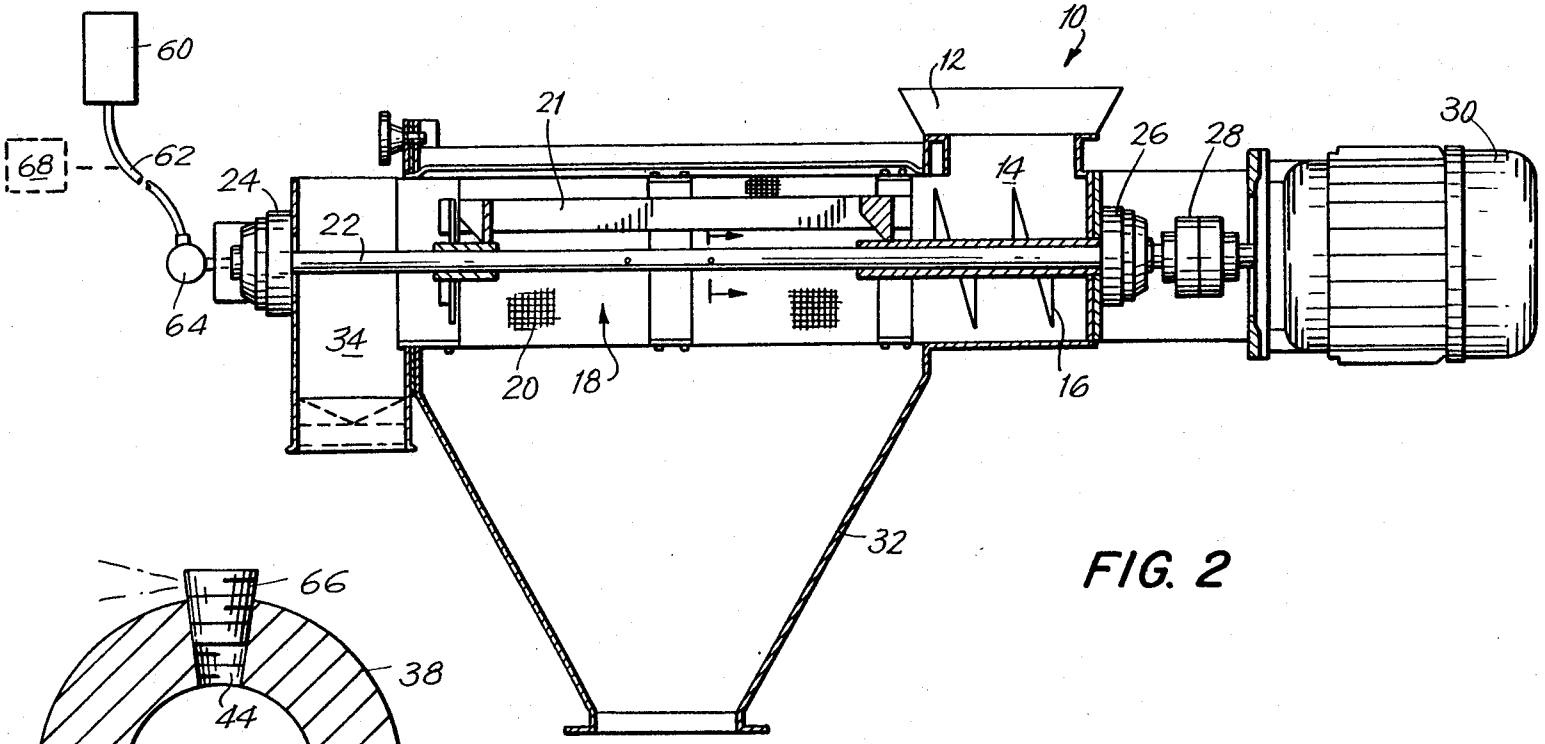
FIG. 2 is a sectional elevation view of a representative sifting apparatus employing the present invention.

Referring initially to FIG. 2, centrifugal sifting apparatus 10 includes an input hopper 12 leading to chamber 14 in which auger 16 is located. The material to be sifted enters into chamber 14 and is driven by the action of auger 16 into sifting chamber 18, whose periphery is formed from a screening material 20 of the desired mesh. Paddles 21 are mounted on a central shaft 22, as is auger 16, which is journaled for rotation in bearings 24, 26 and is joined by coupling 28 to drive motor 30. Mounted below sifting chamber 18 is collection chute 32, into which the sifted material falls. A tramp collection box 34 is provided at the distal end of the sifting chamber for collection of oversized particles and foreign or "tramp" materials rejected by the sifting process. Shaft 22 is adapted to support the spray means and, as detailed in FIG. 1, may preferably be assembled from three sections 36, 38, 40 of rod material. Central portion 38 is provided with central bore 42 (as may be best seen in FIG. 3, and is provided with radial bores 44 connecting central bore 42 to the exterior of the shaft. For a shaft utilized in a sifting apparatus having a sifting chamber 18 of approximately 24 inches in length, the radial bores 44 may preferably be six in number, arranged in two groups of three, the groups being separated by approximately $5\frac{1}{2}$ inches, the bores of each group being disposed at 120° intervals about the circumference of the shaft, $2\frac{1}{4}$ inches apart on center. The shaft sections themselves may be formed of 1 inch nominal stainless steel with bore 42 having a diameter of 0.599 inches. The radial bores 44 may be $\frac{1}{8}$ inch in diameter. Shoulder portions 46, which appear on shaft section 38, as well as on sections 36 and 40, are located as required for bearing support purposes.

Left shaft portion 36 includes through-bore 48 and internal shoulder 50 dimensioned to interfit with bore 42 in central portion 38 to align and join the sections together. If required, the sections may be further fastened by appropriate means, such as pins, bolts or the like. Shaft portion 36 is further provided with flat 52 and flared bore entryway 54. The diameter of bore 48 may preferably be 5/16 inches in diameter.

Third portion 40 of shaft 22 is similarly provided with an internal shoulder portion 56 adapted to mate with central portion 38 and is of solid, rather than hollow, cross-section to serve as a plug for bore 42. Section 40 further includes flat 58 to facilitate connection between the shaft and coupling unit 28.

Referring again to FIG. 2, assembled shaft portions 36, 38, 40 provide the support means for auger 16 and paddles 21, as well as providing a passageway into sifting chamber 18 for a compressed air stream. This stream is generated by compressor means 60, which is coupled to shaft 22 by piping means 62 affixed to a rotary union 64 mounted in bore entryway 54 as shown in FIG. 1. Rotary union 64 maintains an air-tight seal between the rotating shaft 22 and piping means 62 during operation of the sifting unit.

Figure 3:
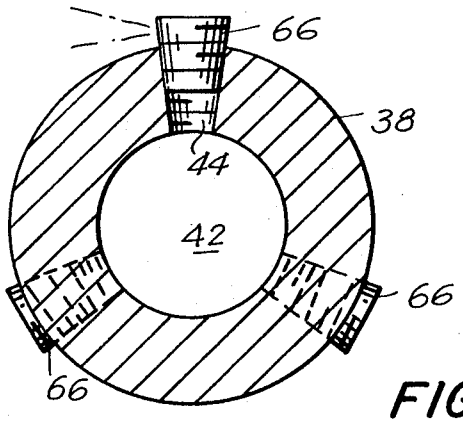
FIG. 3 is a detailed sectional view taken along the section line of FIG. 2 in which a cross-section of the shaft of FIG. 1 is illustrated.

The pattern of air spray emanating from bores 44 may be enhanced or modified as required by the use of appropriate nozzle means 66, as detailed in FIG. 3. For example, a type P "flood jet" nozzle, available from Kason Corporation of Linden, N.J., has been effectively utilized in connection with the present invention and provides an advantageous flat spray pattern for the pressurized air. The bores 44 may be adapted as necessary, such as by tapping, to accommodate such nozzle units. In addition, the compressed air may be pulsed, either continuously or upon operator command to enhance operation and conserve energy, as well as ionized, by appropriate known means to further enhance system throughput and the breakdown of particle clumps and the like. Such pulsation and ionization means are shown generally at 68.

It is to be recognized that adaptations, modifications and adjustments to the invention as described herein may be apparent to those skilled in the art. Accordingly, the scope of coverage for the present invention is to be measured by the claims as set forth herein.

I claim:

1. In a centrifugal sifter apparatus characterized by an elongated sifting chamber having a central axis, a coaxial screen surface therein and a series of paddles mounted on a shaft driven for rotation about said central axis for urging siftable material through said screen surface to separate fines from overs, the improvement comprising a series of nozzle means mounted on said shaft for rotation therewith, said nozzle means being oriented to direct gas streams at said screen surface whereby any of said fines which agglutinate are dislodged from each other and are directed through said screen surface, and a source of compressed air operatively connected to said nozzle means by a portion of said shaft, said shaft portion being hollow to form a conduit for said compressed gas; said hollow portion having a first section to which said nozzle means are mounted having an interior bore operatively connected to a plurality of radial bores, said nozzle means being mounted in said radial bores, and a second section having an interior bore of a lesser diameter than said interior bore of said first section, said first and second shaft sections being joined together in an end-to-end relationship to form an interior passageway through said bores; said second section being coupled to said compressed gas source by a rotary coupling to create a leak proof joint during rotation.

2. The improvement of claim 1 further comprising means operatively connected to said compressed gas source for ionizing said gas streams.

3. The improvement of claim 1 further including pulse means operatively connected to said compressed gas source to modulate the gas flow.

* * * * *